US006543164B1

(12) United States Patent
Sperl et al.

(10) Patent No.: US 6,543,164 B1
(45) Date of Patent: Apr. 8, 2003

(54) PANEL DISPLAY SYSTEM

(75) Inventors: Paul N. Sperl, Bloomington, MN (US); Dixon Gimpel, Richfield, MN (US); William Funk, Eagan, MN (US); Timothy Cota, Bloomington, MN (US)

(73) Assignee: Skyline Displays, Inc., Eagan, MN (US)

( * ) Notice: Subject to any disclaimer, the term of this patent is extended or adjusted under 35 U.S.C. 154(b) by 0 days.

(21) Appl. No.: 09/556,382

(22) Filed: Apr. 24, 2000

(51) Int. Cl.[7] ..... G09F 7/00
(52) U.S. Cl. ..... 40/605; 52/220.7
(58) Field of Search ..... 40/605, 606, 559, 40/782, 783, 784, 785; 52/220.1, 220.7, 239; 160/135

(56) References Cited

U.S. PATENT DOCUMENTS 5,398,376 A * 3/1995 Pollack ..... 16/225
5,537,766 A * 7/1996 Nickens et al. ..... 40/605
5,561,960 A * 10/1996 Minnick et al. ..... 52/239 X
5,974,713 A * 11/1999 Wu ..... 40/733
6,047,509 A * 4/2000 Savoie ..... 52/239 X

* cited by examiner

*Primary Examiner*—Brian K. Green
(74) *Attorney, Agent, or Firm*—Patterson, Thuente, Skaar & Christensen P.A.

(57) ABSTRACT

In a preferred embodiment, a portable display is formed of a plurality of assembleable panels, each of panels having a plurality of edge portions secured together with corner connectors to form a rectangular framework. Panelar sheet material extends over two side of the framework and polyurethane foam in injected into the interior space. Panel connector portions, either of the sliding type, or the peg or plug-in type secure the panels together to form the display. In a preferred embodiment, each panel has four corners each with corner components that engage with the edge portions, preferably by insertion into receiving openings in said edge portions. Said corner components having a receptacle exposed at each corner to permit either connection with plug-in components, for example, panel connectors for vertical stacking of panels or accessory brackets.

13 Claims, 6 Drawing Sheets

PANEL DISPLAY SYSTEM

BACKGROUND OF THE INVENTION

This invention relates to a portable panel display system in which individual display panels may be assembled together in various configurations. The invention also relates to methods of construction of such display systems.

Display panels are widely used in reception areas, trade shows, museums, art exhibits, academic and research society meetings, advertising displays and the like where visual information is temporarily displayed. The faces of these panels may incorporate soft materials (e.g., cork or fabric), laminates, and magnetic materials for temporarily attaching the visual information to the panels. Often such panels will have rigid surfaces with graphics that extend from panel to adjacent panel. In these displays arrangements it is important that adjacent panels are secured together without gaps therebetween which can interrupt and distract the viewer from the image or graphic displayed.

It is also desirable that the panel system may be quickly and easily assembled and disassembled to accommodate a variety of display sizes and configurations, storage, and transportation to another site. It is also desirable that these display panels be securely connected so that display structures are safe. Such panels should also be light in weight to further facilitate assembly and to further provide a safer display.

In various applications it is common and highly desirable to have lighting or other powered accessories included as part of the overall display typically elevated and supported by said display. Such accessories will require electric power and thus wiring to such accessories. Exposed wiring from power outlets or other power sources can be visually distracting and can be hazardous. Typically portable displays and the panels in such displays have had minimal provisions to accommodate such wiring and to conceal such wiring.

SUMMARY OF THE INVENTION

In a preferred embodiment, a portable display is formed of a plurality of assembleable panels, each of such panels having a plurality of edge portions secured together with corner connectors to form a rectangular framework. Panelar sheet material extends over two side of the framework and polyurethane foam in injected into the interior space. Panel connector portions, either of the sliding type, or the peg or plug-in type secure the panels together to form the display. In a preferred embodiment, each panel has a plurality of corners each with corner components that engage with the edge portions, preferably by insertion into receiving openings in said edge portions to form a framework. Said corner components having a receptacle exposed at each corner to permit either connection with plug-in components, for example, panel connectors for vertical stacking of panels or accessory brackets. The panel connectors having a U-shaped portion consistent with the wire management characteristics of the invention that allows a wire to be extended through same permitting attachment of electric powered accessories with concealed power lines.

Preferred embodiments of the individual display panels may be formed of a framework of extruded aluminum or other rigid materials. The framework is comprised of individual sections defining edge portions and having an I-shaped cross section whereby each edge portion has opposite facing channels. The edge portions each having two opposite ends with end surfaces normal to the length of portions. Each edge portion having one channel facing outwardly and another facing inwardly. Adjacent edge portions are joined in an abutting of their respective ends at each corner to form two vertical channeled edge portions and two horizontal channeled edge portions. Each corner of the panel having corner components preferably each having a T-shape with the lower leg of the T positioned horizontally and inserted into an inwardly facing channel of one of the horizontal channeled edge portions. The two upper aligned T-legs are positioned vertically in the inwardly facing channels of the vertical channeled edge portions whereby one of the aligned T-legs of each corner component faces vertically upward or downward and defines an exposed portion with a receptacle.

In a preferred embodiment, the exposed portion of the corner component has a receptacle for receiving plug-in components. Said plug-in components may constitute vertical connector component or feet. The vertical connector components extend between receptacles of adjacent stacked display panels securing same together. In a preferred embodiment said vertical connector portions have different male portions to be received in the receptacles to accomplish different functions. For example, one configuration will have a U-shape to allow the wire conduit defined by the channel to extend therethrough. Another male portion may have a closed solid male portion with detents that securely lock the vertical connector portion into the receptacle.

The framework as described above may be placed in a press with suitable panelar sheets, such as high pressure laminates, spanning the front and back of the framework. A flowable curable material will be injected or placed in the interior space defined by the framework and sheets and allowed to fill said space, for example, polyurethane foam. The corner components each have a secure fit within the edge portions and have a tortuous air vent placed at the interface between the corner component and one or both of the adjoined edge portions. The air vent is appropriately sized and configured such that as the fill material, i.e. expanding urethane foam, reaches restrictions in the vent it clogs the vent minimizing or eliminating excess fill material from escaping from the framework. Expanding polyurethane or similar expansive fill materials may be slightly pressurized from said clogging which will facilitate complete and secure bonding of the urethane to all framework components and the panelar sheets as well as contributing to improved structural strength.

A feature and advantage of the system is that the corner portions have multiple synergistic functions and are of a relatively uncomplicated configuration permitting inexpensive manufacture. Each corner component, in preferred embodiments, is utilized to secure and align the respective edge portions of the framework at the respective corner. Further each corner component provides a receptacle for plug-in components such as vertical connector portions or feet. Moreover, each corner component may provide an air vent with a tortuous path that facilitates the filling of the interior space of the framework with polyurethane foam. Moreover, each corner component has a wire conduit therethrough and further accommodates plug-in components that are compatible with said wire conduit.

BRIEF DESCRIPTION OF THE DRAWINGS

FIG. 7 is a perspective view of a sliding connector in accordance with the invention.

DETAILED DESCRIPTION

Figure 1:
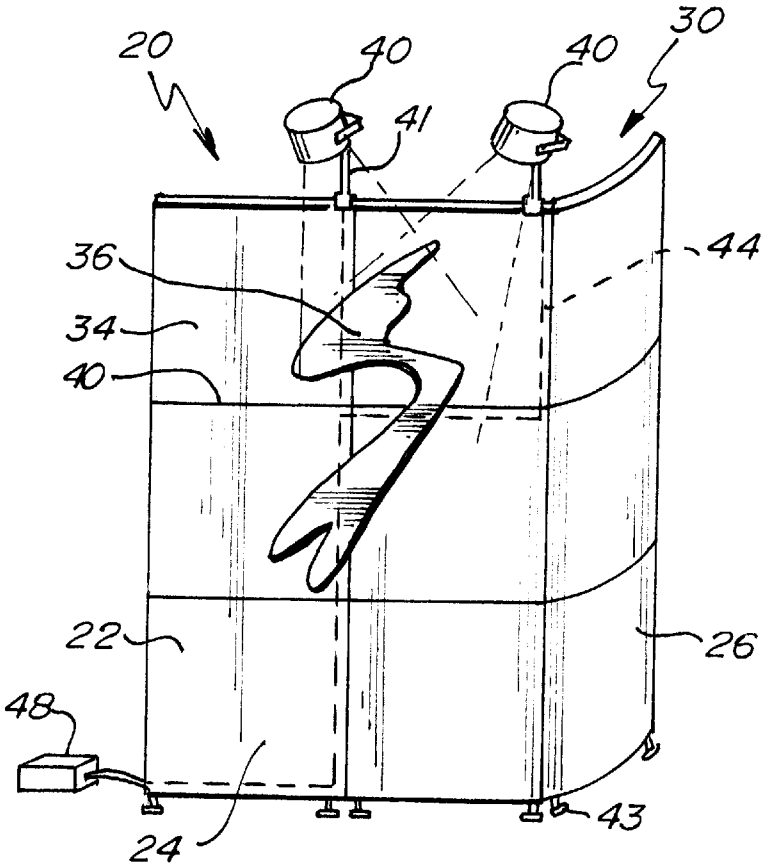
FIG. 1 is a perspective view of a display in accordance with the invention.

Referring to FIG. 1, a display system in accordance with the invention is illustrated and is designated with the numeral 20. Said display system includes a plurality of individual panels 22 which may be generally rectangular and planar in shape as indicated by the panel designation 24 or may have curved sections as represented by the panel enumerated 26. The display system is configured as a display 30 which may have a graphic design or indicia 36 as shown as FIG. 1. Such displays typically require that the juncture 40 between adjacent panels be completely closed to provide a continuous image of the graphics or indicia. The display 30 may also have powered accessories 40 illustrated as spotlights connected to or supported by the display screen 34. Such accessories require power which is provided by the electric wires 44 illustrated by the dashed lines. Such electric wires will suitably be connected to a power outlet or suitable low-voltage power supply 48.

Figure 4:
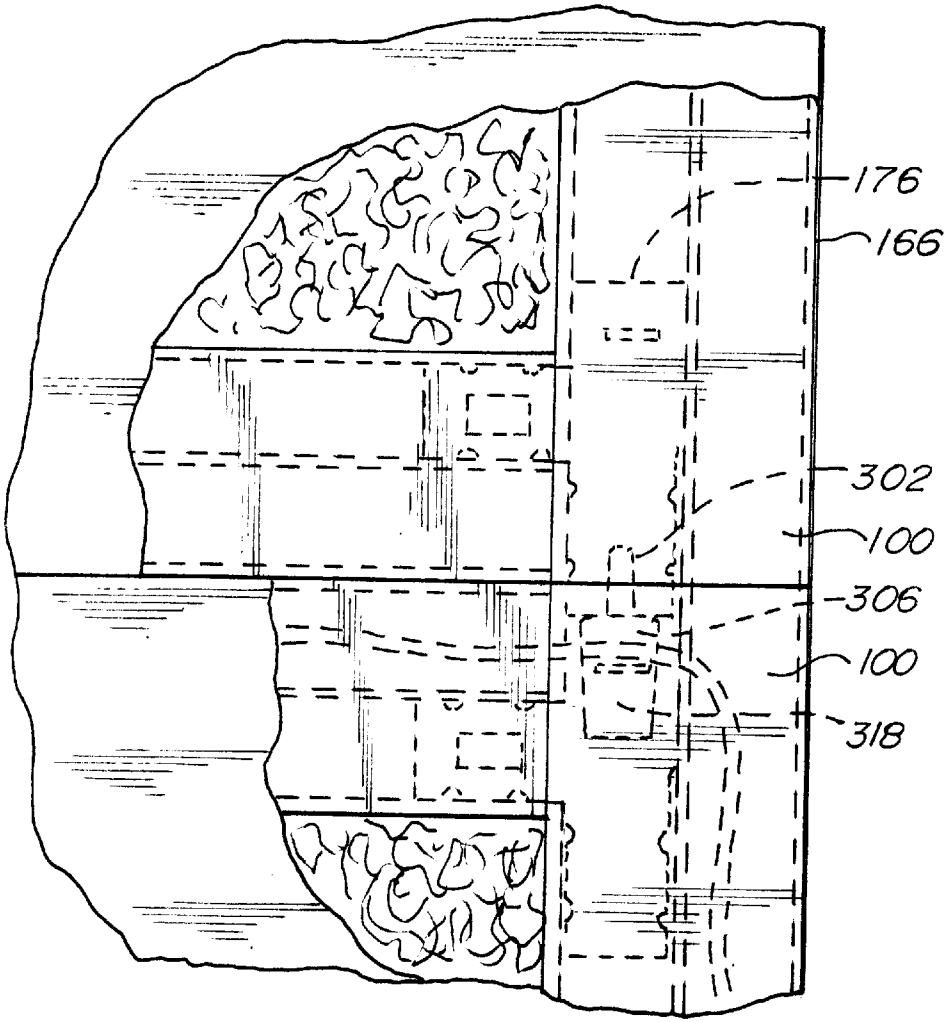
FIG. 4 is a partial sectional elevational view of the corners of a pair of adjacent panels in accordance with the invention.
Figure 2:
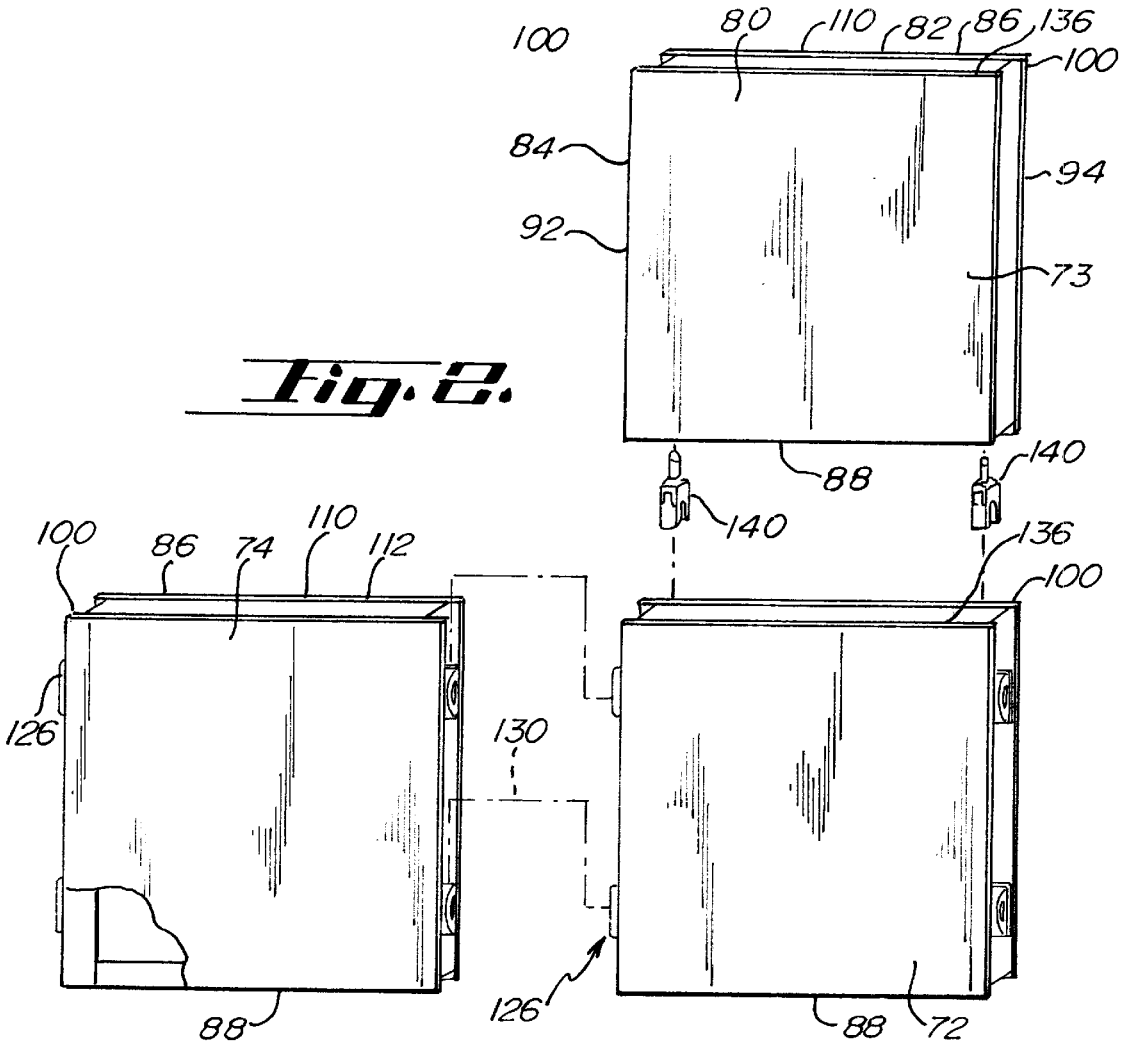
FIG. 2 is a perspective view of display panels in accordance with the invention.
Figure 3:
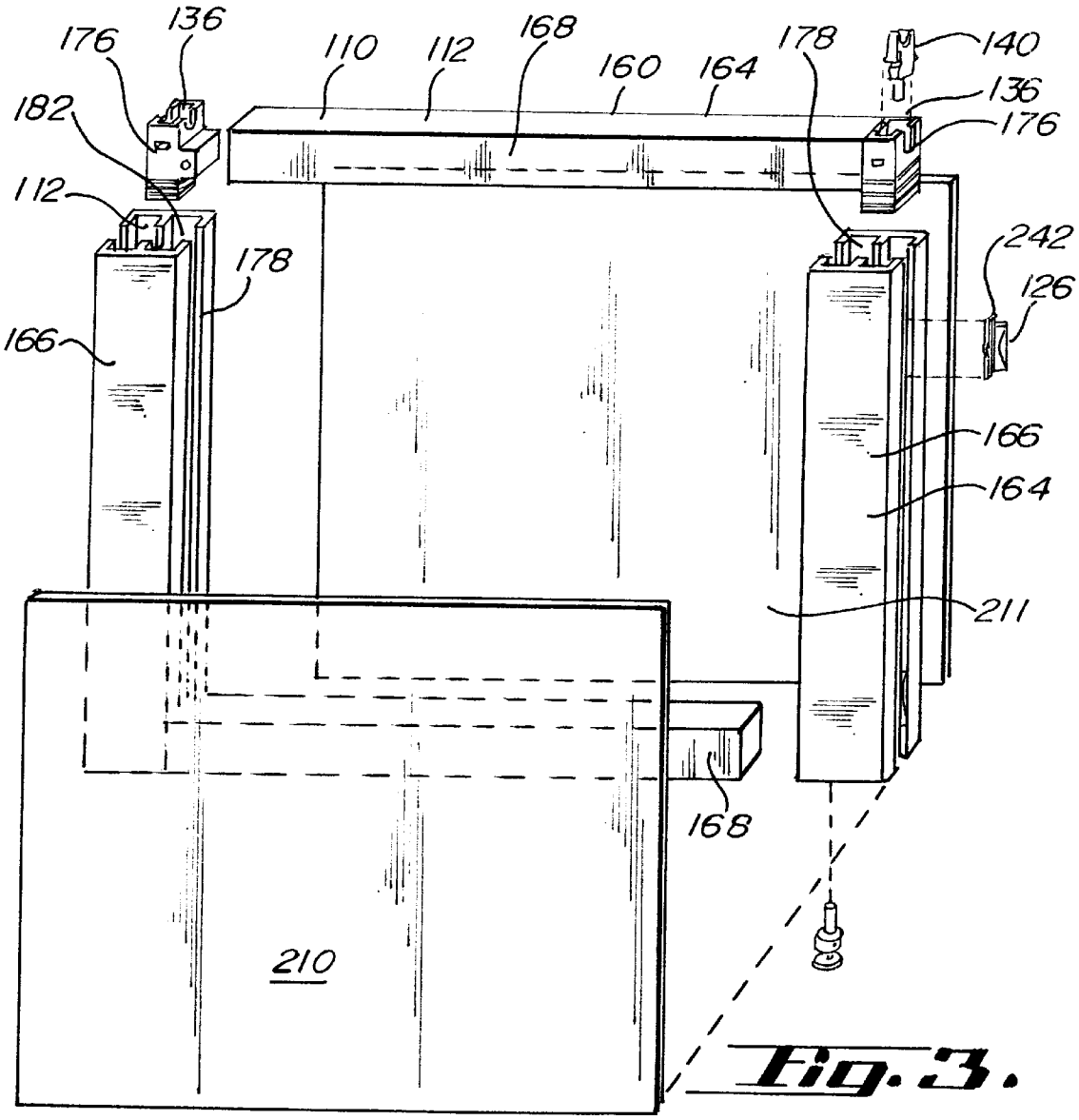
FIG. 3 is an exploded view of a display panel in accordance with the invention.

Referring to FIGS. 2, 3, and 4, various aspects of the invention are illustrated. FIG. 2 illustrates a first panel 72, a second panel 73 and a third panel 74. Each panel has a front side 80, back side 82, a periphery 84, a top horizontal edge 86, bottom horizontal edge 88, a left vertical edge 92, a right vertical edge 94, and four corners 100.

Located at the periphery or perimeter 84 of each panel is an inwardly extending and outwardly facing recess 110. Said recess is configured as an outwardly-facing channel 112. The channel includes side walls 116, 118 and a base portion 120. Positioned at the base on the left vertical edge and right vertical edge are a plurality of sliding connectors 126. These connectors engage with corresponding cooperating connectors on like edges of adjacent panels by offsetting vertically one panel next to the other panel and vertically sliding the panels into alignment as illustrated by the dashed lines of FIG. 2 with the numeral 130.

Positioned at the top horizontal edge at 86 and the bottom horizontal edge 88 are vertical connector portions 136. Vertical connector portions connect stacking connectors 140 that engage the connector portions of vertically adjacent panels such as the first and second panel of FIG. 2 to connect same together. Note that the sliding connectors 126 are illustrated as a component in FIG. 7 and is disclosed in detail in a related Provisional Application Serial No. 60/179785, entitled Panel Display System, filed Feb. 2, 2000, and which is owned by the assignee of the instant application. Said application is hereby incorporated by reference.

The sliding connectors as shown in FIG. 2 are ideally biased to assure that the adjacent perimeters of horizontally adjacent panels are in full contact without gaps. Such bias is preferably formed by integral plastic biasing elements as With regard to the vertically stacked panels, typically gravity will tightly secure same together and preclude any noticeable gaps between adjacent panels.

Referring specifically to FIGS. 3, 4, 5, and 6, details of the construction of a panel in accordance with the invention are illustrated. The panel framework 160 is comprised of a plurality of channeled edge portions 164 including a pair of vertical channeled edge portions 166 and a pair of horizontal channeled edge portions 168. Said opposing pairs are initially secured together by way of corner components 176. Said corner components are illustrated and described in detail below.

Figure 6:
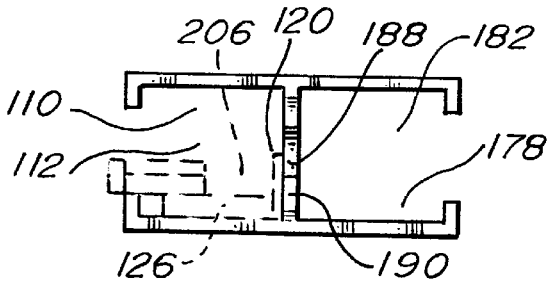
FIG. 6 is an end view of an edge portion in accordance with the invention.
Figure 4:
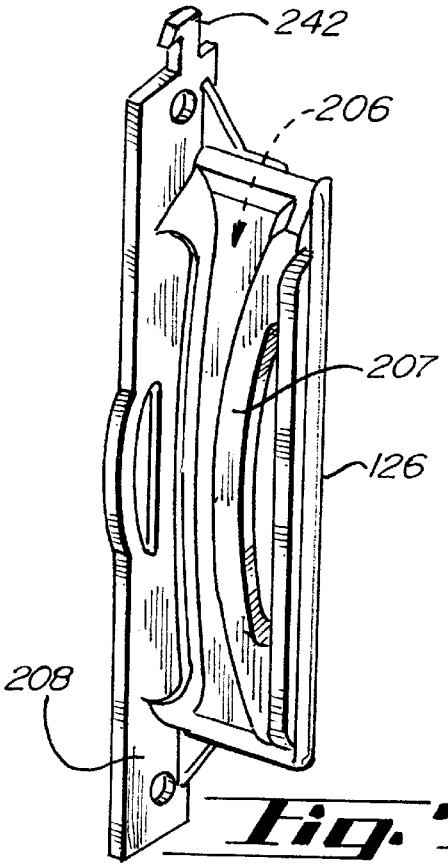
Figure 5:
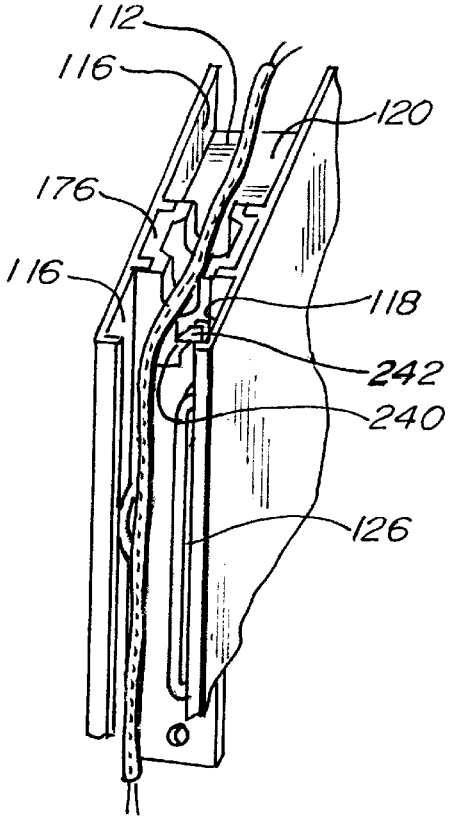
FIG. 5 is a perspective view of a corner of a display panel in accordance with the invention.

Each of the edge portions 164 has inwardly facing channels 178. The corner component engages with the recess 182 of the adjacent inwardly facing channels. The edge portions are generally configured as an I-beam as illustrated in FIG. 6. Note that there is a cut-away 188 in the I-beam cross member 190. The sliding connectors 126 are attached to the base portion 120 of the outwardly facing channel 112 as illustrated by the connector in phantom in FIG. 6 and as shown in FIG. 5. The recess 110 of the I-beam constitutes a wire conduit 200. The cut-away 188 allows the wire conduit to extend with the wire concealed through the corners 100. The sliding connectors 126, shown in isolation in FIG. 7, are suitably conformed to have an opening 206 that facilitates and continues the wire conduit past said sliding connector. Such connectors preferably have a integral plastic biasing element 207 for securing adjacent units together. The base of a preferred sliding connector is plastic and integrally formed with the biasing element. The base and biasing element may be formed of other materials, such as various metals. As such, the base 208 may be separately formed from a spring steel biasing element and secured with conventional fasteners. Alternatively, a metal spring for the biasing element may be insert molded with a plastic base. Referring to FIG. 3, the framework 160 accepts panel or sheet material 210 to cover and traverse the opening 211 defined by said framework. The external panel or sheet material may be adhered by suitable means including by use of the adhesion provided by the polyurethane injection into the core of said panels as discussed below. Alternate means for fastening suitable for particular applications would include traditional fasteners such as rivets or screws. The panels may comprise high pressure laminate commonly known as Formica or may constitute material such as fabric, sheet metal, or foils. In certain embodiments no external panel or sheet material may be utilized and the panel may be formed with the fill material in the interior of the framework exposed. This type of configuration is suitable where differently colored exterior panels may stocked and may be attached to stockpiled display units as necessary for customer orders.

Figure 8:
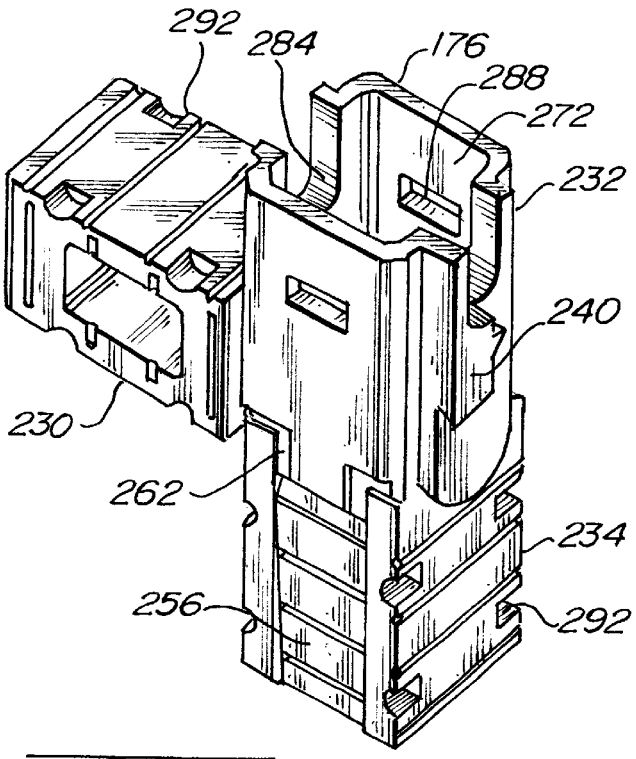
FIG. 8 is a perspective view of a corner connector component in accordance with the invention.
Figure 9:
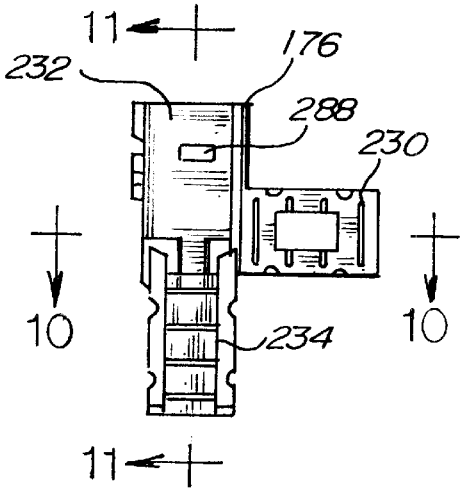
FIG. 9 is a elevational view of a corner connector in accordance with the invention.
Figure 10:
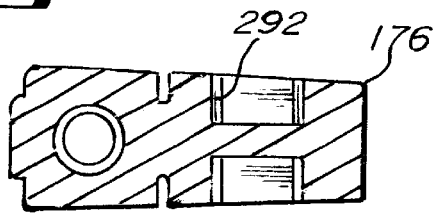
FIG. 10 is a cross-sectional view taken at line 10—10 of FIG. 9.
Figure 11:
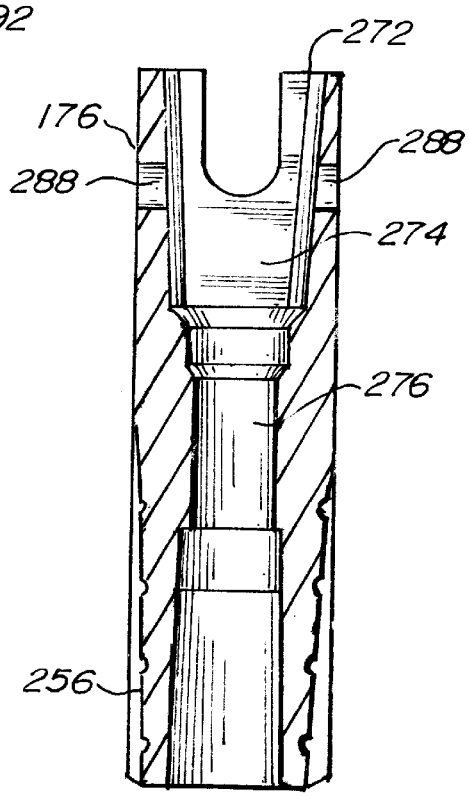
FIG. 11 is a cross-sectional view at line 11—11 of FIG. 9.

Referring to FIGS. 8, 9, 10, and 11, details of the corner component are illustrated. The corner component is generally T-shaped as shown in FIG. 8 with a lower leg 230 and a pair of aligned legs 232, 234. As shown a first leg or lower leg 230 is sized for insertion into the recess 110 defined by the inwardly facing channel of the upper and lower horizontal channeled edge portions 168, not shown in this view. The aligned second legs or upper legs 234 of the T-shaped corner component 234 are inserted into each end of the inwardly facing channel of the vertical channeled edge portions 166. The corner connectors have several significant structural features as follows. A hook member 240 is configured to engage, lock and position a sliding connector 126 at the corresponding hook 242 of said connector. The interior second leg 234 includes an interior tapered portion 256 which helps define a tortuous air vent 262 that allows the injection of and/or expansion of the fill material, i.e. polyurethane foam, up to the corner piece and allows the escape of the displaced air but effectively clogs when the polyurethane reaches said tortuous air vent 262. The exterior third leg 232 of the corner portion includes a receptacle 272 for receiving plug-in components 280 which may comprise stacking connectors 140 or accessory connectors 41, or feet 43 as shown in FIG. 1. Said receptacle includes a first receiving region 274 and a second receiving region 276. The plug-in components may have male portions to engage one or both of the receiving regions. The exterior leg 232 of the corner component has cut-away portions 284 configured as U-shaped openings which define the wire conduit passing therethrough. The legs that engage with the inwardly facing channels of the edge portions, that is legs 230, 232 also have structural features 292, such as notches 293 and recesses 294, which facilitate gripping of the respective edge portions as well as facilitating receiving injected polyurethane at the interfaces between the corner connector components 174 to provide and effect adhesion between said corner connectors and the respective edge portions.

Figure 12:
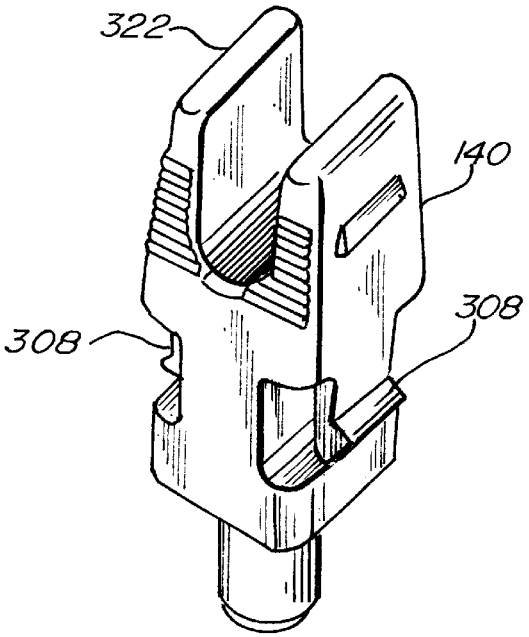
FIG. 12 is a perspective view of a vertical stacking connector in accordance with the invention.
Figure 13:
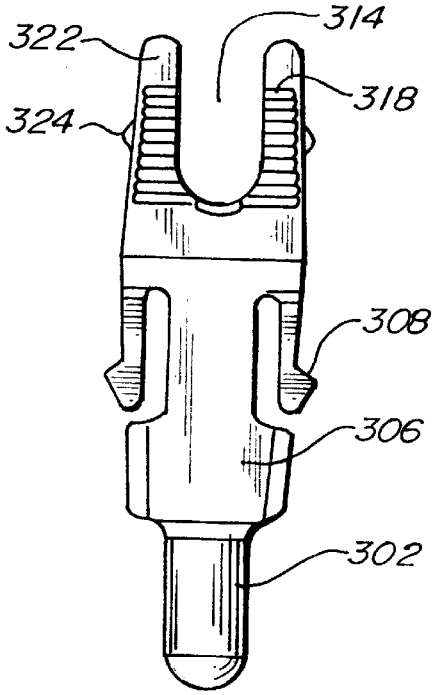
FIG. 13 is an elevational view of the connector of FIG. 12.

Referring to FIGS. 12 and 13, a plug-in component configured as a vertical stacking connector 140 is shown. Said stacking connector has a reduced diameter plug portion 302 which is received in the second receiving region 276 of the reciprocal 272 of the corner component. A wider diameter plug portion 306 extends into the first receiving region 274 of said reciprocal. Detents 308 operate to secure the plug-in component in said receptacle and thus in the panel of which the corner component is part. The plug-in component has an opening 314 configured in a U-shape that defines a wire conduit. Such U-shaped opening preferably has a diameter of 0.25 inches which facilitates power lines of 120 volts. Where low voltage accessories are utilized the diameter of the wire management openings may be reduced. The outer portion 318 of the stacking connector is configured to be received within the reciprocal of the corner connector of a panel, that is adjacent to the panel that the reduced diameter plug portion and second plug portion 306 are engaged with. Said U-shaped facilitates the wire conduit as well as providing some flex to the finger portion 322 which include detents 324. The plug-in components can utilize various other configured upper portions that, for example, would not plug in to an adjacent panel but rather would attach to or be part of an accessory such as the spotlights 40 shown in FIG. 1.

The corner connectors are preferably formed of die-cast zinc or zinc alloy, but may also be formed of other materials such as glass or fiber-filled nylon. Similarly, the plug-in components may be die-cast or made of glass or fiber-filled nylon or other thermoplastics.

The air vent 262 having the tortuous path, may have various configurations. As illustrated, it may be formed by structure in the corner component. Referring to FIG. 4, alternate vents such as use of plugs 335 in apertures 336 formed of sintered beads. The important characteristic of the vent is that it is substantially pervious to the escape of air from the filling or expanding of the fill material and is substantially impervious to the passage of the fill material.

Figure 14:
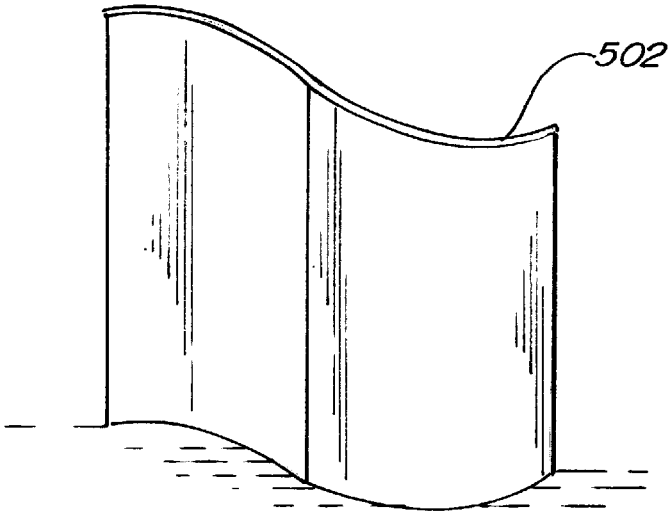
FIG. 14 is a perspective view of an alternative display in accordance with the invention.
Figure 15:
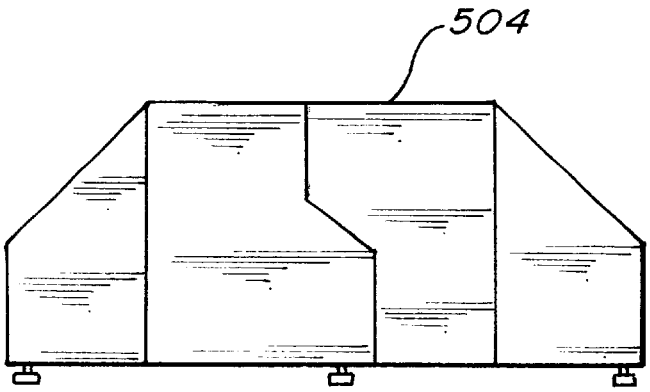
FIG. 15 is an elevation perspective view of an alternative display in accordance with the invention.
Figure 16:
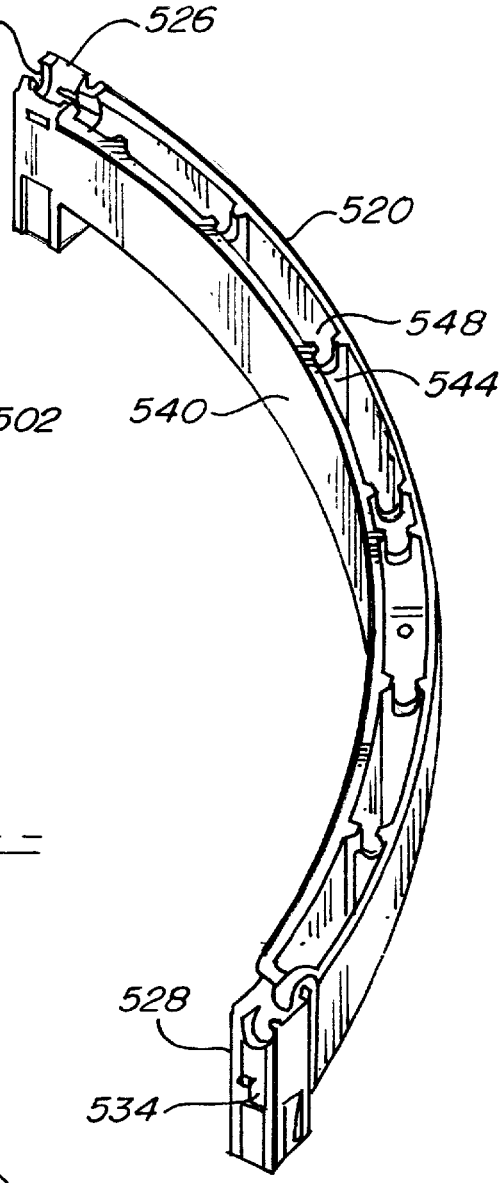
FIG. 16 is a perspective view of a curved connector portion in accordance with the invention.

Referring to FIGS. 14 and 15, two additional portable displays 502, 504 are illustrated. These displays include non-rectangular and non-planar individual display panels. Such panels are constructed and configured to include the inventive aspects described herein. FIG. 16 illustrates a curved connector portion 520, suitable for use in the curved panel section of FIG. 14. Such a curved connector portion may preferably be unitarily formed by injection molding of thermoplastic material. The component includes two corner connector portions 526, 528 generally have the features of the corner connectors described above. Specifically cutaway portions 530 which provide the wire management aspect of the invention are provided as well as structure 534 to provide a tortuous vent. The edge portion 540 may be channel shaped and has a plurality of intermediate structural supports 544 each which has wire management openings 548. Such structural supports provide strength and rigidity to the component.

Figure 17:
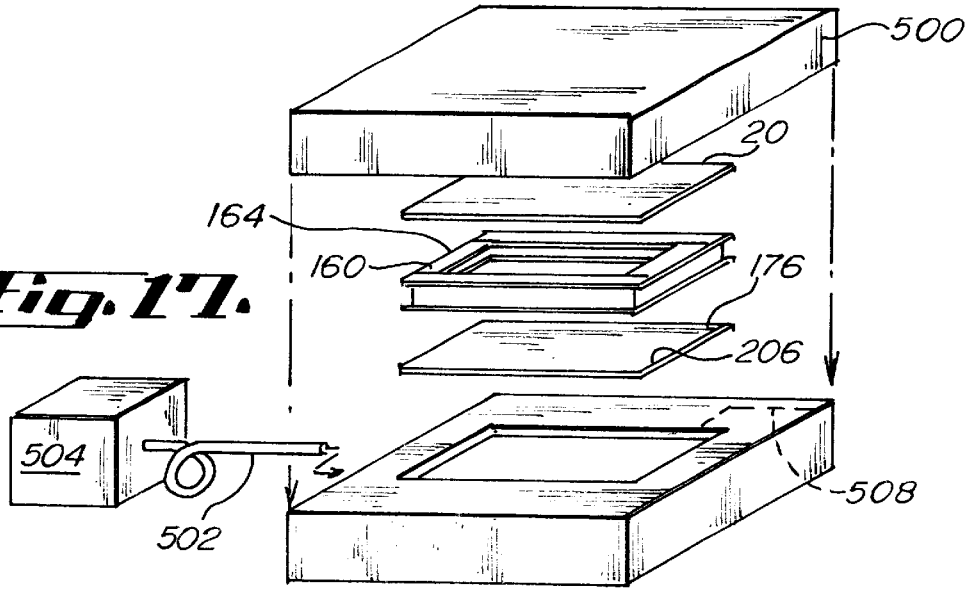
FIG. 17 is a perspective view of a molding arrangement for producing display panels in accordance with the invention.

Referring to FIG. 17, a generic press 500 is illustrated to aid in description of the methodology of forming the panels. The framework 160, including the edge portions 164 and the corner components 176, are placed in a press with the paneler sheet members 206 if desired. The press is closed and polyurethane expanding foam is injected by a tool 502 from a supply source 504. The foam core is allowed to cure sufficiently to avoid any further expansion and is then removed from the press. The injection tool 502 may be suitably through an aperture in one of the edge portions. During said injection, appropriate vents 508 are provided in the press and are ideally located at the corners such that air that passes through the tortuous air vent at the corner connector components 176 may be readily discharged.

The skilled person will appreciate that variation of the disclosed arrangements are possible without departing from the invention. Accordingly, the above description of several embodiments is made by way of example and not for the purposes of limitation. It will be clear to the skilled person that minor modifications can be made to the method without significant changes to the operation described above. The present invention is intended to be limited only by the spirit and scope of the following claims.

This application is related to the Application with the same inventors filed on even date with this application, and entitled Panel Display System with Wire Management. Said application is incorporated by reference.

We claim:

1. A display system comprised of a plurality of rectangular display panels joinable together in rows and columns, each display panel having a front side, a back side, four corners, a perimeter with a top horizontal edge, a bottom horizontal edge, a left vertical edge, and a right vertical edge, each panel comprising:

a) a pair of vertical channeled edge portions positioned at the left vertical edge and the right vertical edge, each vertical channeled edge portion having an outwardly facing channel, an inwardly facing channel, and a pair of edge portion ends, each edge portion end having an end surface, b) a pair of horizontal channeled edge portions positioned at the top horizontal edge and bottom horizontal edge, each channeled edge portion having an outwardly facing channel, an inwardly facing channel, and a pair of edge portion ends, each edge portion end having an end surface, c) a plurality of T-shaped corner components, each positioned at a corner and having three legs, one leg of each T-shaped corner component inserted into an inwardly facing channel of one of the horizontal channeled edge portions and another leg inserted into an inwardly facing channel of one of the vertical channeled edge portions, whereby the pair of horizontal channeled edge portions, the pair of vertical channeled edge portions, and the T-shaped corner components, form a rectangular framework for the display panel, and d) a pair of exterior panelar sheets traversing the rectangular framework, and e) a fill material in the space defined by the rectangular framework and the exterior panelar sheets, said fill material adhering to the rectangular framework and the exterior panelar sheets.

2. The display system of claim 1, wherein a third leg of each of the T-shaped corner components has a receptacle for receiving plug-in components.

3. The display system of claim 2 wherein the pair of horizontal channeled edge portions are placed intermediate the pair of vertical channeled edge portions whereby end surfaces of the edge portion ends of the horizontal channeled edge portions confront the inwardly facing channels of the vertical channel edge portions.

4. The display system of claim 1, wherein each of the horizontal channeled edge portions and each of the vertical channeled edge portions is configured as an I-beam.

5. The display system of claim 1, wherein one of the legs of each of the corner components has a tapered portion that is adhered to the fill material.

6. The display system of claim 1, wherein the third leg of each corner component is exposed at the respective corner of the respective panel, has an opening defining a wire conduit, and wherein each corner component defines a tortuous vent for facilitating the insertion of the fill material.

7. The display system of claim 6, wherein each display system further comprises a plurality of panel stacking connectors for placement between vertically adjacent display panels, each stacking connector having a first stacking connector end and a second stacking connector end, each of said connectors configured to plug into the corner component receptacles without blocking the wire conduit.

8. The display system of claim 7 wherein at least one connector end of each panel stacking connector display system further comprises a U-shaped portion to provide a wire conduit at the corner portion where the stacking connector is used.

9. A display system comprised of a plurality of rectangular shaped panels coupled together at their edges by a plurality of connectors for forming a display, each panel having a top edge, a bottom edge, a left edge, a right edge, a front side, and a back side, each panel comprising a pair of vertical edge portions at the left edge and right edge respectively, the vertical edge portions each having an H-shape in cross-section with an outwardly facing channel and an inwardly facing channel, and having two exposed end portions, the top edge of each panel having two corner components with vertically aligned receptacle portions positioned within the inwardly facing channel of the vertical channeled edge portions at the exposed end portions, the receptacle portions for connecting together vertically stacked panels, each panel further comprising at least one panelar sheet on the front side, the vertical edge portions, the corner components and the panelar sheet adhered together by a fill material.

10. The display system of claim 9, wherein each panel couples with another panel at the vertical edge portions by way of a plurality of sliding connectors extending between said panels, and wherein said sliding connectors extend within said recess, whereby when said vertical edge portion of panel is coupled with another panel, said connectors are concealed from the front side and the back side.

11. The display system of claim 9 wherein the outwardly facing channel defines a wire conduit and the plurality of connectors each have an opening for receiving wire.

12. A display system comprising a plurality of panels removably connected together, each panel comprising:

a framework with a pair of vertical portions and a pair of horizontal portions joined with four corner portions;

at least one panelar sheet adhered to the framework and extending between the vertical portions and horizontal portions;

a plurality of vertical connector portions for providing stacking of vertically adjacent panels, the vertical connector portions each having a opening therein for receiving wiring;

a plurality of horizontal connector portions for connecting horizontally adjacent panels, the horizontal connector portions each having an opening therein for receiving wiring; and wherein each corner portion has three legs, with a first leg engaged with one of the horizontal portions, a second leg engaged with one of the vertical portions, and a third leg having a receptacle sized for receiving vertical connector portions.

13. A display system comprising a plurality of panels removably connected together, each panel comprising:

a framework with a pair of vertical portions and a pair of horizontal portions joined with four corner portions;

at least one panelar sheet adhered to the framework and extending between the vertical portions and horizontal portions;

a plurality of vertical connector portions for providing stacking of vertically adjacent panels, the vertical connector portions each having a opening therein for receiving wiring;

a plurality of horizontal connector portions for connecting horizontally adjacent panels, the horizontal connector portions each having an opening therein for receiving wiring; and a fill material adhering together the four corner portions the pair of horizontal portions, the pair of vertical portions, and the at least one panelar sheet, wherein each corner portion has three legs, with a first leg engaged with one of the horizontal portions, a second leg engaged with one of the vertical portions, and a third leg having a receptacle sized for receiving vertical connector portions, and wherein each horizontal connector portion is configured to slidingly engage in a vertical direction with a like connector on a horizontally adjacent panel.

* * * * *